US005460570A

United States Patent [19]

Okamura et al.

[11] Patent Number: 5,460,570

[45] Date of Patent: Oct. 24, 1995

[54] VENTILATOR FOR ELEVATOR CAGE

[75] Inventors: Akihiko Okamura; Hideya Kohara, both of Tokyo; Katsuyoshi Nagayasu, Kanagawa, all of Japan

[73] Assignee: Kabushiki Kaisha Toshiba, Kawasaki, Japan

[21] Appl. No.: 181,414

[22] Filed: Jan. 14, 1994

[30] Foreign Application Priority Data

Feb. 4, 1993 [JP] Japan ..... 5-017306

[51] Int. Cl.[6] ..... F24F 7/007

[52] U.S. Cl. ..... 454/68; 181/224; 181/225; 454/252; 454/906

[58] Field of Search ..... 138/39; 181/211, 181/224, 225; 454/68, 252, 906, 244

[56] References Cited

U.S. PATENT DOCUMENTS

| | | | |
|---|---|---|---|
| 1,033,963 | 7/1912 | Surprise | 181/224 |
| 2,112,608 | 3/1938 | Schmidt | 181/225 X |
| 2,310,414 | 2/1943 | Fritzam et al. | 454/68 |
| 3,125,286 | 3/1964 | Sanders | 181/224 X |
| 4,403,370 | 9/1983 | Rapp | 181/225 X |
| 4,773,310 | 9/1988 | Corwin | 454/244 |
| 5,029,218 | 7/1991 | Nagayasu . | |

FOREIGN PATENT DOCUMENTS

| | | | |
|---|---|---|---|
| 4-209188 | 7/1992 | Japan . | |
| 4-281125 | 10/1992 | Japan | 165/135 |

OTHER PUBLICATIONS

*Elevator, Escalator and Amusement Rides Conference,* No. 930–6, Feb. 22, 1993, Akihiko Okamura, et al., "Noise Reduction Technology on Ultra–High Speed Elevators", pp. 31–34 (with partial English translation).

*Primary Examiner*—Harold Joyce
*Attorney, Agent, or Firm*—Oblon, Spivak, McClelland, Maier & Neustadt

[57] ABSTRACT

An elevator cage with an ventilator which has supply system for supplying fresh air into the cage and exhaust system for exhausting air from the cage. An active noise controller is provided to at least the supply system to cancel noise which is caused by a supply fan provided in the supply system and changing air force between the cage and a path to guide the cage while the cage moves at high speed.

17 Claims, 3 Drawing Sheets

VENTILATOR FOR ELEVATOR CAGE

BACKGROUND OF THE INVENTION

1. Field of the Invention

This invention relates to a ventilator for an elevator cage and more particularly to the ventilator wherein an active noise controller cancels noise entering into the cage.

2. Description of the Related Art

In recent years, an elevator for vertical transport has been required to provide higher speed and greater capabilities to meet the needs for super highrise buildings.

The elevator in a super highrise building has had many technical problems which previous elevators did not have. A representative problem is loud noise caused by changing air force between the elevator cage and a path to guide the cage. The noise is especially generated while the cage is moving at high speed. The noise enters the cage and makes passengers uncomfortable.

A ventilator with a silencer has been provided to block the noise around the cage from entering into the cage.

In this ventilator, as shown in fig.1 and fig.2, an exhaust fan 4 having a silencer 3 with sound-absorbing materials is installed on the top 2 of a cage 1.

Exhaust fan 4 introduces air into cage 1 through an air gate 6 formed around an illumination case 5 mounted to the top 2 and the noise generated by exhaust fan 4 is attenuated by silencer 3.

An exhaust aisle 7 formed to be similar to a labyrinth is provided at the lower part of cage 1.

FIG. 2 shows exhaust aisle 7 in detail. A first plate 8 having a plurality of obstacle sheets 8*a* is built on a board 1*a* of cage 1.

A second plate 9 is connected to the lower and outside part of a side board 1*b* of cage 1 with nut and bolt 10 so that first plate 8 is covered with second plate 9.

A plurality of obstacle sheets 9*a* are formed on second plate 9 and alternately provided against obstacle sheets 8*a*.

Exhaust aisle 7 is zigzag constructed by obstacle sheets 8*a* and 9*a*.

Exhaust aisle 7 exhausts the air from the cage 1 according to the stream of air shown by the arrow in FIG. 2. Noise on the outside of the cage may be blocked by obstacle sheets 8*a* and 9*a*.

The ventilator having silencer 3 with sound-absorbing materials and exhaust aisle 7 with obstacle sheets 8*a* and 9*a* is supposed to prevent noise from entering into cage 1, which is said to be passive noise control. However, the noise control may be limited.

There is especially noise around 125 Hz in cage 1, consequently it is important to attenuate such noise.

However, silencer 3 can not effectively restrain a low frequency range of noise (less than 500 Hz), for the low frequency noise has a long wavelength and is apt to penetrate the sound-absorbing materials. Further silencer 3 is restricted in size because silencer 3 is mounted on top 2 of cage 1.

Also, the construction of exhaust aisle 7 itself is complicated and its ability to efficiently attenuate the noise on the outside may be limited.

3. Summary of the Invention

It is an object of this invention to provide a ventilator for an elevator cage so as to provide a cage which is silent and comfortable for passengers to ride in.

In order to achieve this object and other objects readily apparent to those skilled in the art, there is provided a ventilator which has a supply fan mounted on a top of the elevator cage for supplying the air into the cage, a first duct for directing the air from the supply fan into the cage, sound-absorbing materials spread on an inside of the first duct for attenuating comparatively high frequency noise, and active noise control means for attenuating comparatively low frequency noise in the first duct.

DESCRIPTION OF THE PREFERRED EMBODIMENTS

A first embodiment of the invention will be described in detail with reference to FIGS. 3–6.

Figure 1:
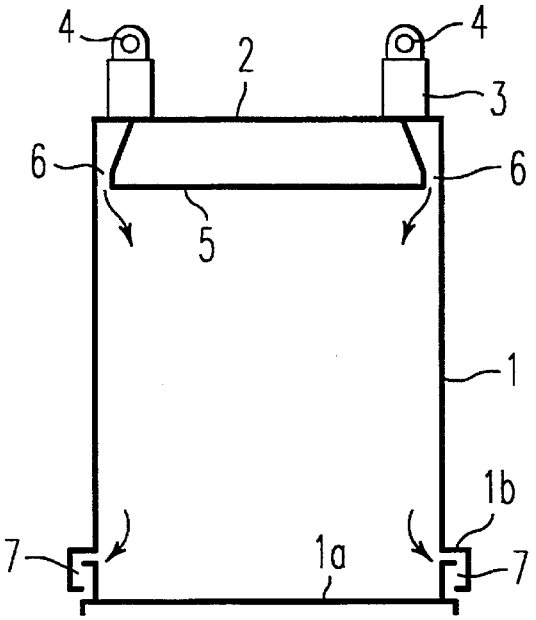
FIG. 1 PRIOR ART
FIG. 1 is a sectional view illustrating an elevator of the prior art.
Figure 2:
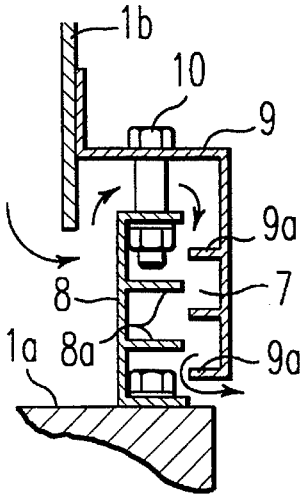
FIG. 2 PRIOR ART
FIG. 2 is a sectional view illustrating an exhaust aisle of the prior art.
Figure 3:
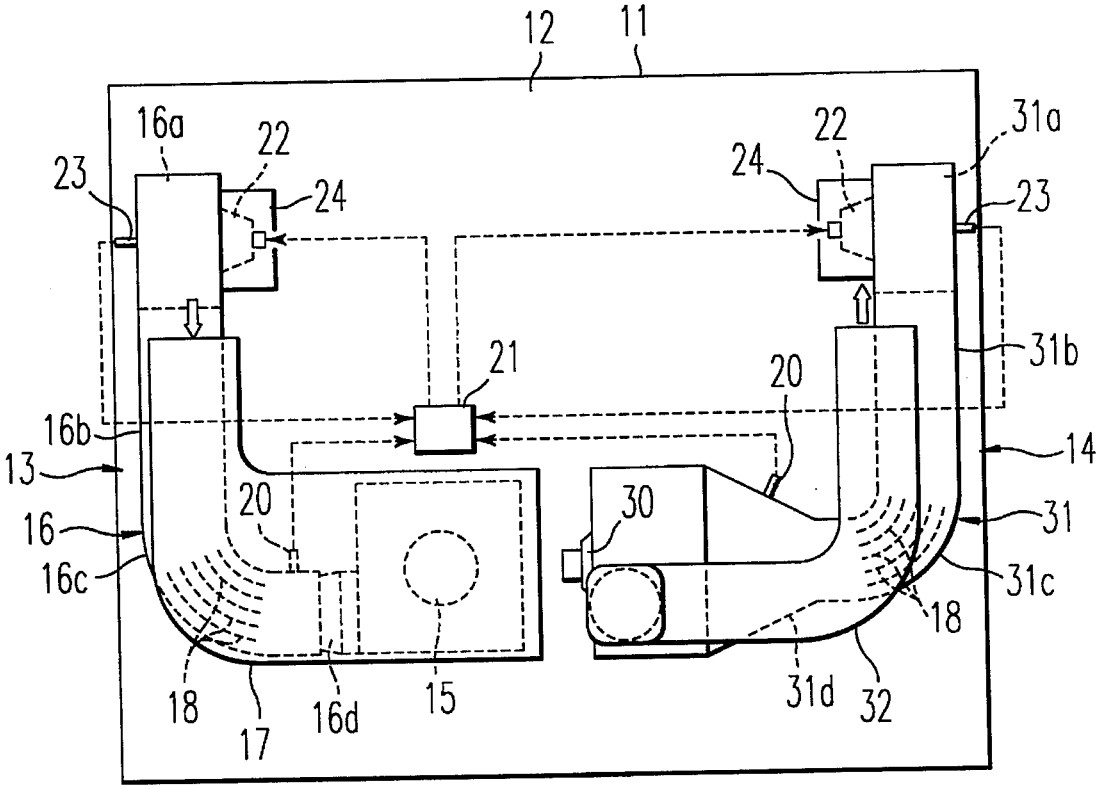
FIG. 3 is a top view illustrating a ventilator mounted on the top of an elevator cage constructed according to the present invention.
Figure 4:
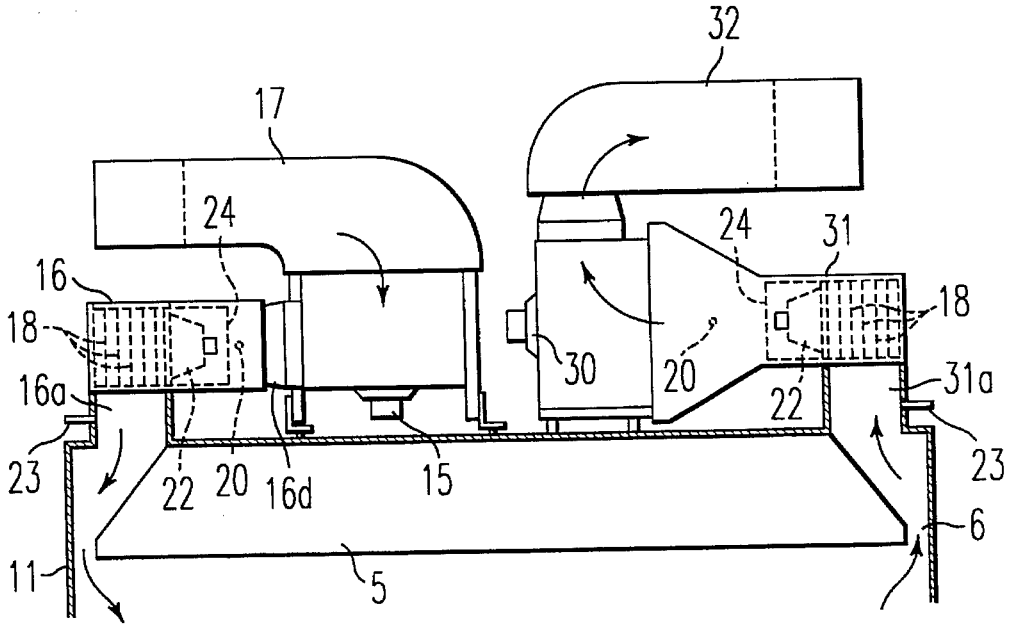
FIG. 4 is a front view illustrating a ventilator mounted on the top of the elevator cage constructed according to the present invention.

Referring to FIGS. 3 through 4, a supply system 13 for supplying air into a cage 11 and an exhaust system 14 for exhausting the air to the outside of cage 11, respectively, are mounted on the top 12 of cage 11 so as to be within the space of the top 12.

Supply system 13 includes a supply fan 15 for introducing air from the outside, a first duct 16 connected to cage 11 and supply fan 15, for directing fresh air from supply fan 15 to the inside of cage 11, a second duct 17 connected to the upper part of supply fan 15, for directing fresh air on the outside, and an active noise controller. First duct 16 consists of a vertical portion 16*a* connected to cage 11, a straight portion 16*b*, a corner portion 16*c*, and a connected portion 16*d* jointed to supply fan 15. A strainer 18 is formed on the inside of corner portion 16*c*. Second duct 17 is formed in an L-shape and is mounted above first duct 16. The active noise controller includes a sensing microphone 20 attached to connected portion 16*d*, for detecting a source of noise of supply fan 15 and outputting a noise signal in response to the source of noise, a control unit 21 mounted on the top 12, for generating a cancellation signal in response to the noise signal, an active speaker 22 attached to straight portion 16*b* corresponding to vertical portion 16*a*, and a microphone 23 attached to vertical portion 16*a*, for evaluating remaining noise, which is not canceled even after the above noise canceling process, in vertical portion 16*a* and transmitting a check signal to control unit 21.

Exhaust system 14 is symmetrically installed to supply system 13 so as to be within the space of top 12. Exhaust system 14 includes an exhaust fan 30, a third duct 31 connected to cage 11 and exhaust fan 30, for directing the air from cage 11 to exhaust fan 30, a fourth duct 32 connected to the upper part of exhaust fan 30, for directing the air to the outside, and an active noise controller as described above.

Third duct 31 consists of a vertical portion 31*a* connected to cage 11, a straight portion 31*b*, a corner portion 31*c*, and a connected portion 31*d* jointed to exhaust fan 30. A strainer 18 is formed on the inside of corner portion 31*c*. Fourth duct 32 is formed in an L-shape and is mounted above third duct 31. The active noise controller includes sensing microphone 20 attached to connected portion 31*d*, for detecting a source of noise of exhaust fan 30 and outputting a noise signal in response to the source of noise, control unit 21 mounted on the top 12, for generating a cancellation signal in response to the noise signal, active speaker 22 attached to straight portion 31*b* corresponding to vertical portion 31*a*, and microphone 23 attached to vertical portion 31*a*, for checking remaining noise in vertical portion 31*a* and transmitting a check signal to control unit 21. Active speaker 22 is covered with a box 24.

Figure 5:
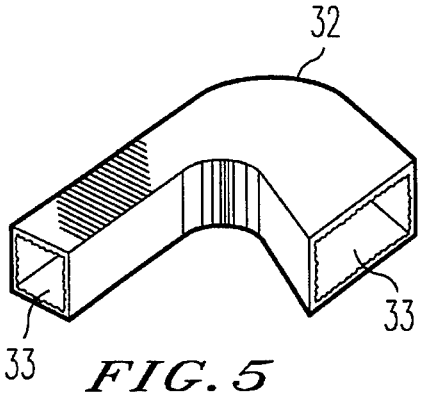
FIG. 5 is a perspective view illustrating a fourth duct having sound-absorbing materials.

As shown in FIG. 5, sound-absorbing materials 33 are respectively spread on the inside of first duct 16, second duct 17, third duct 31, and fourth duct 32, for attenuating comparatively high frequency noise, e.g. 500 Hz or higher.

Figure 6:
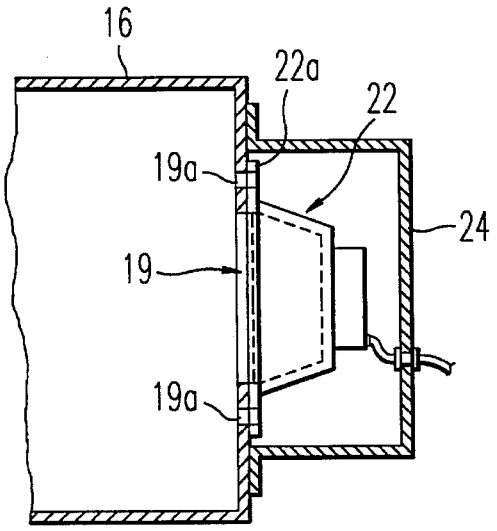
FIG. 6 is a sectional view illustrating an active speaker of a first embodiment of the invention.

FIG. 6 shows the attachment of active speaker 22 to first duct 16. Active speaker 22 is also attached to third duct 31 but not shown. As shown in FIG. 6, active speaker 22 is attached to the surface of first duct 16 with a flange 22a formed in active speaker 22 and covered with box 24. Active speaker 22 makes an artificial sound through an opening 19 formed in first duct 16. A plurality of holes 19*a*, which are about 30 mm in diameter, are respectively formed to first duct 16 and flange 22*a* to maintain the same atmospheric pressure between first duct 16 and box 24. In an elevator provided in a highrise building, atmospheric pressure of a lower floor is quite different from atmospheric pressure of a higher floor. Consequently, when cage 11 moves from a lower floor to a higher floor at high speed, it makes a difference of atmospheric pressure between the inside of first duct 16 (in front of active speaker 22) and the outside of first duct 16 (at the back of active speaker 22). As a result the efficiency with which active speaker 22 operates to make an artificial sound in response to the cancellation signal generated with control unit 21 may be affected because of a change of a characteristic of active speaker 22 as a result of the change.

In supply system 13, at first fresh air is introduced with supply fan 15 through second duct 17. Then first duct 16 directs the fresh air from supply fan 15 to cage 11. At this time, sensing microphone 20 detects a source of noise of supply fan 15 and outputs a noise signal in response to the source of noise. Then control unit 21 inputs the noise signal, analyzes a waveform of the noise signal and generates a cancellation signal. Then active speaker 22 recieves the cancellation signal and provides an artificial sound which is the same amplitude and antiphase as the noise signal. Finally microphone 23 checks remaining noise in vertical portion 16*a* and feeds back a check signal to control unit 21.

In exhaust system 14, exhaust fan 30 exhausts air from cage 11 through third duct 31. Finally fourth duct 32 directs the air from exhaust fan 30 to the outside of cage 11. At this time, sensing microphone 20 detects a source of noise of exhaust fan 30 and outputs a noise signal in response to the source of noise. Then control unit 21 inputs the noise signal, analyzes a waveform of the noise signal and generates a cancellation signal. Active speaker 22 recieves the cancellation signal and provides an artificial sound which is the same amplitude and antiphase as the noise signal. Finally microphone 23 checks remaining noise in vertical portion 31*a* and feeds back a check signal to control unit 21. In this way, comparatively low frequency noise, which is mainly caused by supply fan 15 and exhaust fan 30, is canceled with the active noise controller. Comparatively high frequency noise, which is mainly caused by noise around cage 11 while cage 11 is moving, is attenuated with sound-absorbing materials respectively spread on the insides of first duct 16, second duct 17, third duct 31, and fourth duct 32.

Whenever a source of noise generated by supply fan 15 through first duct 16 is cancelled with the active noise controller, it is necessary for active speaker 22 provided in first duct 16 to make an artificial sound in response to a noise signal by the time the source of noise travels from a position of sensing microphone 20 attached to first duct 16 to a position of active speaker 22. However the noise signal is transmitted from sensing microphone 20 to control unit 21 and analyzed. Consequently the active noise controller requires enough time to analyze the noise signal because of the response time of the active speaker and a low pass filter circuit provided in control unit 21. It is therefore necessary that first duct 16 and third duct 31 have a sufficient length in view of the response time. However the top 12 of cage 11 has not enough space to install long ducts. Further the ducts are installed on the top 12 of cage 11, should be within the space. Since the ducts would otherwise cause interference when cage 11 moves.

Accordingly, first duct 16 and third duct 31 have corner portions 16*c*, 31*c* and straight portions 16*b*, 31*b* to provide sufficient length. Active speaker 22 is at a sufficient distance from sensing microphone 20. As strainer 18 is formed on the inside of corner portions 16*c*, 31*c*, the active noise controller is able to have a correlative relationship between the position of sensing microphone 20 and position of active speaker 22. Consequently, the waveform of the source of noise which is generated by supply fan 15 or exhaust fan 30 is provided as the same waveform at the position of active speaker 22. The resistance of flow in corner portions 16*c*, 31*c* is reduced with strainer 18 and a good flow of ventilating air is provided. Direction of flow in supply system 13 is opposite to the direction of flow in exhaust system 14. The frequency range and amplitude of noise entering into supply system 13 or exhaust system 14 are different, respectively. Accordingly, control unit 21 respectively controls supply system 13 and exhaust system 14.

In this embodiment, supply fan 15 and exhaust fan 30 ventilate cage 11. The active noise controller and sound-absorbing materials 33 exactly attenuate noise which is caused by changing air force between cage 11 and a path for guiding cage 11 while cage 11 is moving at high speed, and generated by supply fan 15 and exhaust fan 30. Supply system 13 and exhaust system 14 are installed on top 12 of cage 11 so as to be within the space of top 12 and not to interfere with an apparatus provided to a path, because first duct 16, second duct 17, third duct 31 and fourth duct 32 have corners, respectively, and second duct 17 and fourth duct 32 are provided above first duct 16 and third duct 31. Also the ducts have sufficient length to attenuate noise. As sound-absorbing materials 33 are spread on the inside of the ducts, high frequency noise is exactly absorbed and attenuated. Active speaker 22 provides an artificial sound, which is the same amplitude and antiphase as a noise signal, in response to a noise signal which is transmitted from sensing microphone 20 and analyzed at control unit 21 by the time the source of noise travels from the position of sensing microphone 20 to the position of active speaker 22. This is possible because first duct 16 and third duct 31 are long enough and active speaker 22 is attached at a sufficient distance from sensing microphone 20. The active noise controller exactly cancels low frequency noise, which sound-absorbing materials 33 can not attenuate. The artificial sound made with active speaker 22 is revised and precisely controlled, for remaining noise in vertical portion 16*a*, 31*a* is fed back to control unit 21. In this way, comparatively low frequency noise (less than 500 Hz) is canceled with active noise control and comparatively high frequency noise (500 Hz or higher) is attenuated with sound-absorbing materials 33. According to an experiment, high frequency noise (500 to 600 Hz) in cage 11 was attenuated about 5 to 10 dB and low frequency(125 Hz) noise, which especially exists in cage 11, was almost canceled.

Figure 7:
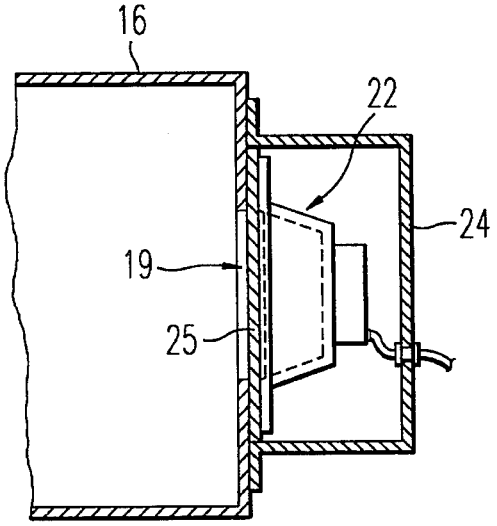
FIG. 7 is a sectional view illustrating an active speaker of a second embodiment of the invention.

In a second embodiment, shown in FIG. 7, a cover 25 is attached to opening 19 and active speaker 22 is installed on cover 25. Consequently active speaker 22 is completely covered with box 24 and cover 25 so as to be airtight. Cover 25 is made of plastic thin plate, which is less than 1 mm thick, so as to transmit an artificial sound thoroughly. In this way, active speaker 22 is not influenced by a change in atmospheric pressure between a lower floor and a higher floor and exactly makes artificial sound.

In these embodiments, if second duct 17 and fourth duct 32 are removed from the ventilator, the ventilator can achieve objects of the invention. Further, the ventilator is able to obtain effects as described above without provision of the active noise controller for exhaust system 14.

Although the invention has been described in its preferred form with a certain degree of particularity, it is understood that the present disclosure of the preferred embodiments may be altered in the details of construction, and such alternations of the combination and arrangements of parts may be resorted to without departing from the spirit and the scope of the invention as hereinafter claimed.

What is claimed is:

1. A ventilator for an elevator cage comprising:

a supply fan mounted on top of the elevator cage, for supplying air for the cage;

a first duct for directing the air from the supply fan into the cage;

sound-absorbing materials spread on an inside surface of the first duct for attenuating comparatively high frequency noise; and active noise control means for canceling comparatively low frequency noise in the first duct;

wherein said first duct comprises a connecting portion connected to said supply fan, a straight portion, and a corner portion positioned between said straight portion and said connecting portion; and said active noise control means comprises:

a sensing microphone positioned adjacent to said connecting portion for detecting a noise in the first duct and outputting a noise signal;

a control unit for generating a cancellation signal in response to the noise signal; and an active speaker attached to a rear end of the straight portion which is remote from said corner portion for canceling the noise in response to the cancellation signal.

2. A ventilator as claimed in claim 1, further comprising a strainer mounted within the corner portion.

3. A ventilator as claimed in claim 1, further comprising a second duct for directing air to the supply fan.

4. A ventilator as claimed in claim 3, wherein the second duct has a straight portion and a corner portion.

5. A ventilator as claimed in claim 3, wherein the second duct is mounted above the first duct.

6. A ventilator as claimed in claim 1, wherein said first duct further comprises a vertical section positioned at the end of the straight portion and leading into said cage, and the active noise control means further comprises:

a microphone positioned in said vertical section for detecting a remaining noise which is not cancelled with the active speaker and outputting a check signal in response to the remaining noise to the control unit;

the control unit correcting the cancellation signal in response to the check signal.

7. A ventilator as claimed in claim 6, wherein the first duct has a sufficient length so that the active speaker provides an artificial sound in response to the cancellation signal by the time a noise caused by the supply fan travels from a position of the sensing microphone to a position of the active speaker.

8. A ventilator for an elevator cage comprising:

a supply fan mounted on a top of the elevator cage for supplying air for the cage;

a first duct on the top of the elevator cage for directing the air from the supply fan into the cage;

an exhaust fan mounted on the top of the elevator cage for exhausting air from the cage;

a second duct on the top of the elevator cage for directing the air from the cage to the exhaust fan;

sound-absorbing materials spread on an inside surface of the first duct and the second duct for attenuating comparatively high frequency noise; and active noise control means for canceling comparatively low frequency noise in the first duct and the second duct.

9. A ventilator as claimed in claim 8, wherein each of the first duct and the second duct has a straight portion and a corner portion.

10. A ventilator as claimed in claim 9, further comprising a strainer mounted within the corner portions of the first and second ducts.

11. A ventilator as claimed in claim 8, further comprising a third duct for directing air to the supply fan; and a fourth duct for directing air from the exhaust fan to atmosphere.

12. A ventilator as claimed in claim 11, wherein each of the third duct and the fourth duct has a straight portion and a corner portion.

13. A ventilator as claimed in claim 11, wherein the third duct is mounted above the first duct, the fourth duct is mounted above the second duct.

14. A ventilator as claimed in claim 8, wherein the active noise control means includes a sensing microphone for detecting noise in the first duct and the second duct and outputting a noise signal, a control unit for generating a cancellation signal in response to the noise signal, and an active speaker for cancelling the noise in response to the cancellation signal.

15. A ventilator as claimed in claim 14, wherein the active noise control means includes a sensing microphone for detecting noise in the first duct and the second duct and outputting a noise signal, a control unit for generating a cancellation signal in response to the noise signal, an active speaker for cancelling the noise in response to the cancellation signal, and a microphone for detecting remaining noise which is not canceled with the active speaker and outputting a check signal in response to the remaining noise to the control unit, the control unit corrects the cancellation signal in response to the check signal.

16. A ventilator as claimed in claim 14, wherein each of the first duct and the second duct includes a straight portion, a corner portion and a connected portion for connecting between the corner portion and the supply fan or the exhaust fan, the sensing microphone mounted at the connected portion, the active speaker mounted on the straight portion at a rear end of the straight portion which is remote from the corner portion.

17. A ventilator as claimed in claim 15, wherein each of the first duct and the second duct has a sufficient length so that the active speaker provides an artificial sound in response to the cancellation signal by the time a noise caused by the supply fan or exhaust fan travels from a position of the sensing microphone to a position of the active speaker.

* * * * *